United States Patent [19]

Clifton

[11] 4,334,673

[45] Jun. 15, 1982

[54] DELIVERY MECHANISM

[75] Inventor: Kenneth C. Clifton, Pittsburgh, Pa.

[73] Assignee: Harris Corporation, Dayton, Ohio

[21] Appl. No.: 174,461

[22] Filed: Aug. 1, 1980

[51] Int. Cl.[3] ..... B65H 29/66

[52] U.S. Cl. ..... 271/65; 271/187

[58] Field of Search ..... 271/65, 186, 187, 302, 271/303

[56] References Cited

U.S. PATENT DOCUMENTS

| | | | |
|---|---|---|---|
| 1,866,812 | 7/1932 | Lammerich | 271/303 |
| 2,649,303 | 8/1953 | Fuller | 271/65 |
| 2,904,334 | 9/1959 | Cundall | 271/65 |

FOREIGN PATENT DOCUMENTS

| | | | |
|---|---|---|---|
| 1496243 | 12/1977 | United Kingdom | 271/65 |

*Primary Examiner*—Richard A. Schacher

*Attorney, Agent, or Firm*—Biebel, French & Nauman

[57] ABSTRACT

Apparatus for delivering business forms and the like selectably in a "face up" or "face down" position, which incorporates a set of creels and a delivery conveyor that can be selectably positioned for receiving individual forms from a separator conveyor and then shingling the forms in either a "face up" or "face down" position. The creels and one end of the delivery conveyor are mounted on rotatable plates which permit either the creels or the one end of the delivery conveyor to be positioned adjacent the separator conveyor.

7 Claims, 12 Drawing Figures

DELIVERY MECHANISM

BACKGROUND OF THE INVENTION

1. Field of the Invention

The present invention relates to delivery mechanisms, and more particularly, to apparatus for receiving a continuous series of discrete, separate business forms or the like, and placing them in a "face up" or "face down" position.

2. Prior Art

In the business forms industry where large volumes of multiple page forms, such as those commonly referred to as snap-set forms, it is often necessary to number the forms sequentially. It is common to number these forms either on the printing press when the forms are initially being printed or on the collator where multiple sheets are brought together, glued and then cut into individual forms.

Delivery units, such as the general type to which the present invention pertains, are usually positioned after the collator or press, in the flow path of the business forms and receive the business forms, place them in a shingled line and convey them to a batching station, also part of the delivery unit, where they are stacked in predetermined numbers of forms in each of the batches and then packaged for shipment. In those cases where these business forms are numbered, it is important that they be stacked in the proper order so that the numbering sequence proceeds from first to last or last to first, as desired.

It is generally most desirable that these consecutively numbered business forms be delivered with the low number on top. With this requirement, a "face up" delivery requires that numbers put on the forms at the press be put on low number first and high number last, while, if the numbers are put on at the collator, they are delivered high number first and low number last.

Thus, in those instances where a "face up" delivery is necessary, with collator numbered sets, for example, a large quantity of overprint at the press must be run so that if any waste or scrap during collating occurs, there will be enough of the business forms to produce the end of the run which will have the needed low or starting number.

A similar problem exists with a "face down" delivery. The difficulty here is just the opposite as that mentioned above in that the numbering on the collator will be from the lowest to the highest number, but numbering on the press will be from the highest to the lowest. This means that in the "face down" delivery, where the business forms were numbered on the press, it will be necessary to run a sufficiently large number of overprint for start up and other possible mistakes at the press. In addition, if difficulties occur at the collator the entire numbering system may be disrupted.

In the past, it has been necessary for the business forms production industry to maintain available at its printing facilities both "face up" and "face down" delivery apparatus in order to accommodate the differences mentioned above in connection with numbering at the press or at the collator. If the types of runs are frequently changed a substantial amount of labor is involved with continuously changing delivery units in order to accommodate the different types of runs. In addition, there is substantial down time in the operation in order to permit these changes to be made.

SUMMARY OF THE INVENTION

The present invention overcomes the above described difficulties and disadvantages associated with prior art delivery mechanisms by providing an apparatus which receives a continuous series of business forms in a "face up" position from a collator and separates the forms into batches in either a "face up" or "face down" sequence.

These advantages are provided by a delivery apparatus which includes a set of creels which receive the individual business forms from a continuous stream of forms issuing from a collator or a press and which inverts the forms before laying them on a delivery conveyor in a shingled formation where they are then transported to a batching mechanism. The apparatus has both the creels and one end of the delivery conveyor mounted between rotatable plates which can position either the creels or the delivery conveyor for receiving the business forms from a press or collator so that this one machine is capable of batching the business forms in either "face up" or "face down" position, as desired.

Sets of upper and lower separator conveyors are utilized to receive the individual business forms from the press or collator to which the apparatus is connected, in order that some separation between adjacent forms can be provided before the forms are delivered to the creels or the delivery conveyor. The delivery conveyor or the creels are then selectably positionable at the output end of the sets of separator conveyors to receive the individual forms at a reduced linear speed so that the forms can be shingled for easier batching.

When the creels are positioned adjacent the separator conveyors for receiving the individual business forms, the adjacent end of the delivery conveyor is positioned beneath the creels for receiving the business forms after they have been inverted by the creels through rotation around approximately one-half of the rotational path of the creels. The delivery conveyor moves at a slower linear speed than the separator belts and the creel is rotated at an appropriate speed to produce shingling of the forms as they are conveyed downstream in the movement of the forms toward the batching apparatus. Adjustable stop plates are mounted between the plates supporting the creels and adjacent end of the delivery conveyor in order to provide a positive stop for the release of the business forms as they are rotated by the individual "fingers" of the creels. The forms will thus be released at the same location in order to make an acurate alignment of the forms in their shingled condition on the delivery conveyor.

When it is desired to deliver the business forms in their "face up" position as received from the separator conveyors, the plates supporting the creels and adjacent end of the delivery conveyor are rotated to move the creels down out of the way and simultaneously bring the end of the delivery conveyor up to a position adjacent the separator conveyors for receiving the business forms directly. The speed of the delivery conveyor is maintained at a lower rate than the separator conveyors so that the forms will still be positioned in a shingled manner as they proceed along the delivery conveyor.

The delivery conveyor is comprised of a plurality of endless belts positioned adjacent one another across the width of the delivery apparatus and supported at each end of the conveyor by rollers so that the upper flight of the belts provides a conveying surface for movement of the business forms in their shingled series. One of the rollers is mounted to the plate to which the creels are also attached, for moving that end of the conveyor into and out of position adjacent the separator conveyor.

The rollers supporting the remote end of the conveyor belts are mounted to a shaft fixed in the frame of the apparatus adjacent the batching mechanism. Thus, when the plates supporting the one end of the delivery conveyor and the creels are rotated in order to move the creels and delivery conveyor into the desired positions, the distance between the sets of rollers at the opposite ends of the delivery conveyor changes and causes a temporary slackening in the belts. This is compensated for to a great extent by a tensioning roller arrangement which takes up the slack on the belts in the delivery conveyor as the plates are rotated.

When the delivery conveyor is in either of its intended operating positions, i.e. adjacent the separator conveyor or beneath the creels for receiving the forms from the creels, the belts are at their maximum extension to produce the delivery conveyor surface on their upper flights. In addition, a plate is provided beneath the upper flight of the belts in order to provide additional support for conveying the shingled forms without having a droop in the belts which could affect their uniformity of spacing as the forms are conveyed along the delivery conveyor.

The plates supporting the creels and rollers on one end of the delivery conveyor are easily rotated to position the creels and delivery conveyor in their desired position, by a chain and sprocket arrangement which through rotation of a handle can quickly change the positioning of the creels and delivery conveyor to their desired positions. The creels are continuously rotated whether or not they are actually being utilized or are positioned out of the way for delivery of the forms directly to the delivery conveyor. The drive arrangement for the creels is through a belt and pulley arrangement which is interconnected to the main gear drive of the apparatus and can be easily changed to adjust the speed of receiving the forms and shingling them. The delivery conveyor is likewise positively driven from the main gear drive of the apparatus and can also be easily adjusted for accommodating different speeds of receipt and delivery of the business forms.

Since it is necessary for such delivery apparatus to be able to accommodate business forms of, for example, 3 2/5 inches in length to 17 inches, or even larger, it is necessary to be able to adjust the rotational speeds of the creels as well as the linear speeds of the delivery conveyor. The ease with which this can be accomplished in the present apparatus is a substantial advantage over prior art devices. A particular advantage is provided by a special creel assembly which, through simple and quick adjustment, permits the number of "fingers" for receiving individual forms to be doubled or halved as is necessary for the length of forms being batched. This eliminates the need associated with prior art devices of actually changing the creels to different configurations of creels in order to span the entire normal range of business forms sizes. This, again, substantially reduces the labor involved in switching from one job to another.

Other objects and advantages of the invention will be apparent from the following description, the accompany drawings and the appended claims.

DETAILED DESCRIPTION OF THE PREFERRED EMBODIMENT

Figure 1:
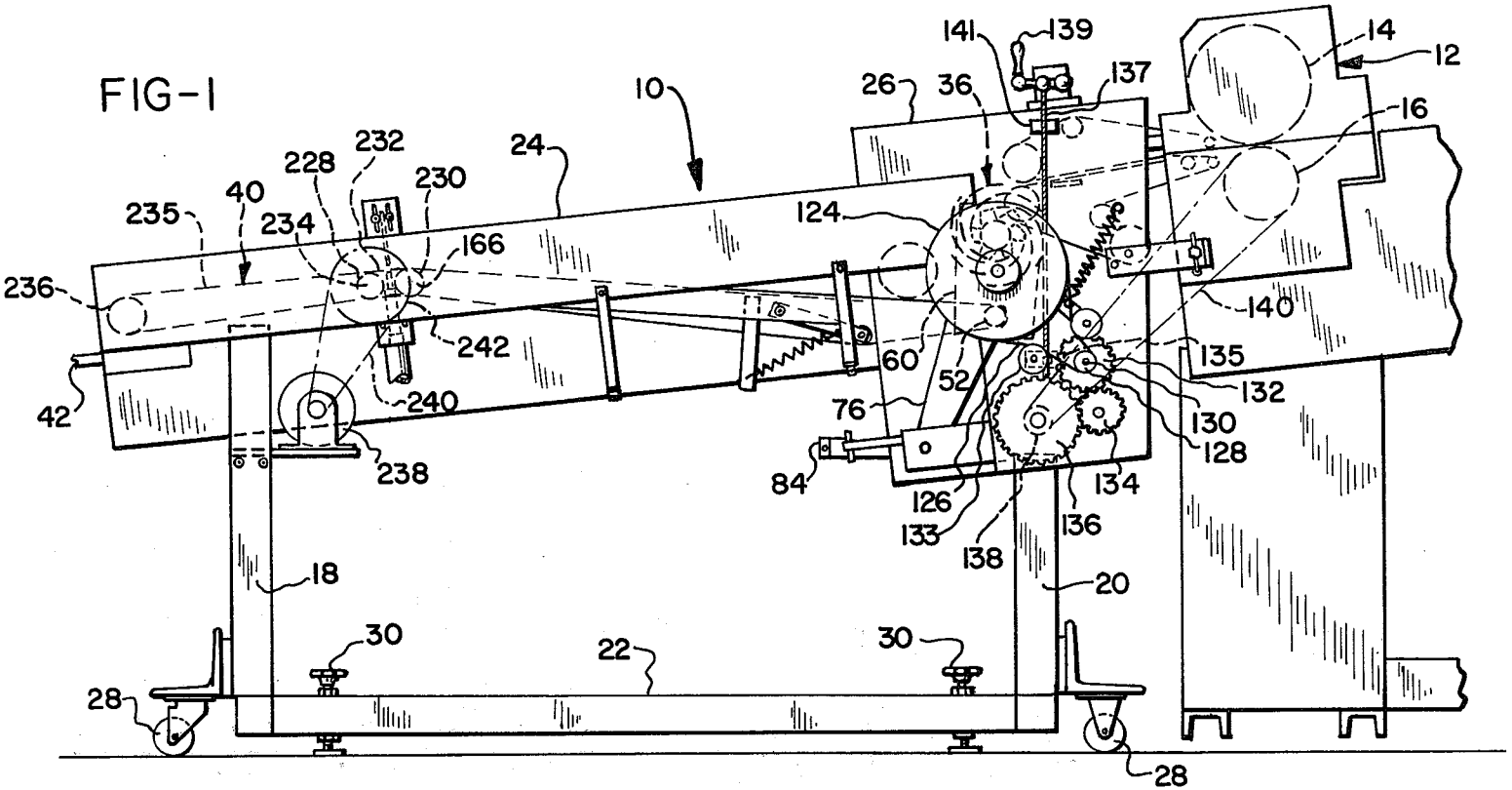
FIG. 1 is a somewhat schematic side view of the preferred embodiment of delivery apparatus of the present invention, illustrating the relative positions of its major components.

The delivery apparatus 10 of the present invention is illustrated generally in FIG. 1 secured to the end of a conventional collating apparatus 12 which is only schematically illustrated to show the final cutting cylinder 14 and associated anvil cylinder 16 which are used to conventionally sever the business forms into discrete lengths and forms no part of the present invention. The delivery apparatus 10 has a main frame structure fabricated, for example, of angle or channel irons, with parallel spaced upstanding legs 18 and 20 on each side of the apparatus and which are welded to a rectangular base frame 22 to provide a rigid stable support for the apparatus.

Pairs of side plates 24 and 26 are bolted to the upper portions of the legs 18 and 20 on opposite side of the apparatus for supporting the various gears, pulleys and shafts described in detail below. A set of coaster wheels 28 are mounted at each of the corners of the base frame 22 for ease of movement of the apparatus into position adjacent the collator or press with which it is to be used.

Likewise, a set of support jacks 30 are positioned adjacent each of the coaster wheels 28 for aligning the delivery apparatus with the output of the collator or press with which it is to be associated and for stabilizing the unit and lifting it off the coaster wheels so that it will remain stationary during use.

Figure 2:
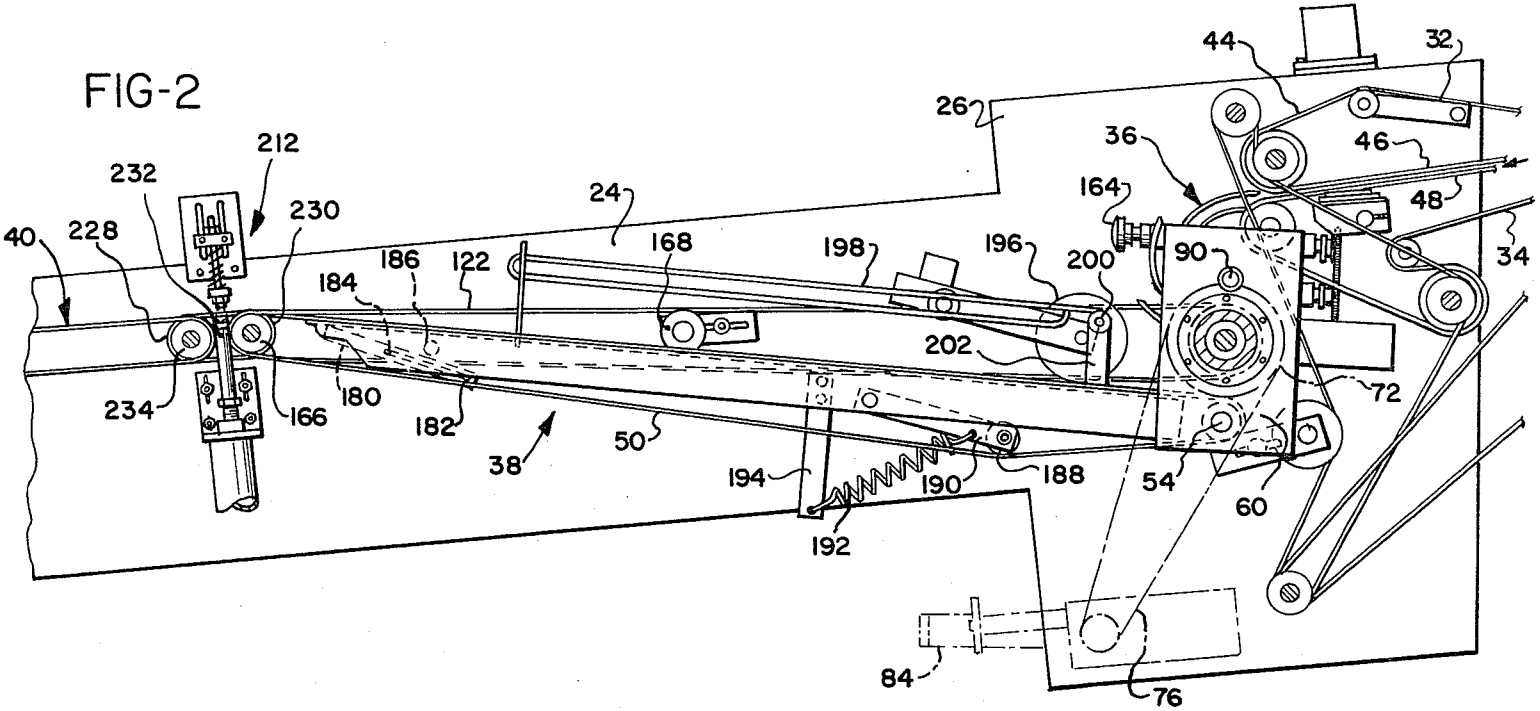
FIG. 2 is an enlarged somewhat schematic view, similar to FIG. 1, of a portion of the preferred embodiment, illustrating the creels in position for receiving business forms from the separator conveyors.
Figure 3:
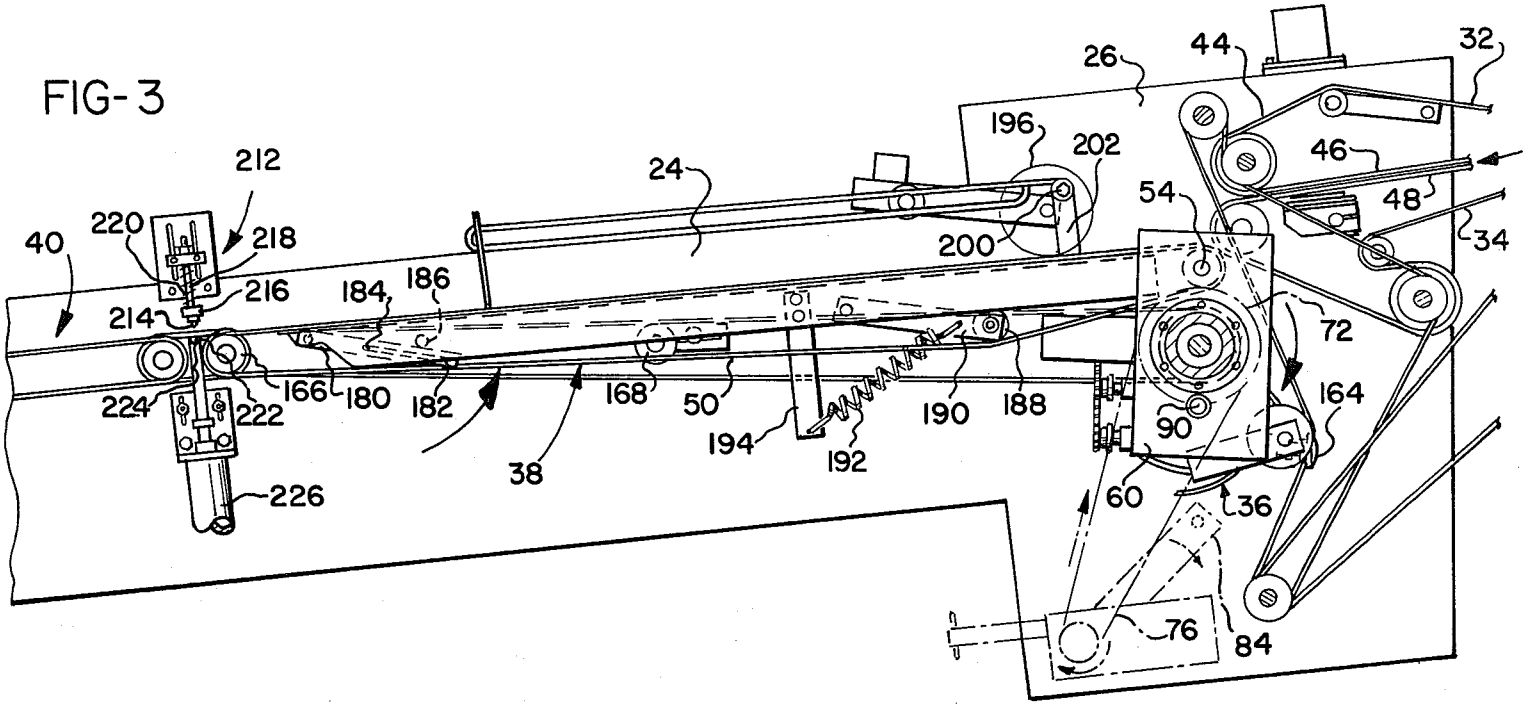
FIG. 3 is a view similar to FIG. 2 with the creels being positioned out of the way and the delivery conveyor being positioned adjacent the separator conveyor for receiving business forms.

Referring now more particularly to FIGS. 2 and 3, the major components of the delivery apparatus include upper and lower separator conveyors 32 and 34, respectively, which receive the continuous supply of business forms from the collator 12; the creel assemblies 36 which, when in the operative position as shown in FIG. 2, receive individual business forms from the output end of the separator conveyors 32 and 34; the delivery conveyor 38, the upper flight of which receives business forms either directly from the separator conveyors 32 and 34 or from the creel assemblies 36, depending upon the operating condition of the apparatus; the sweep belt conveyor 40 which receives the shingled business forms from the delivery conveyor 38 and moves them to the batch collecting tray 42 (shown in FIG. 1) where they are accumulated in batches with a predetermined number of business forms in each batch.

The separator belt conveyors or infeed conveyors 32 and 34, which receive the stream of separate business forms from the output end of the collator 12 or press with which the delivery apparatus 10 is associated, are of generally conventional construction, being formed of a plurality of endless belts 44 mounted widthwise across the machine on a plurality of rollers mounted on shafts extending between the side plates 26 so as to produce substantially parallel adjacent flights 46 and 48 in the upper and lower separator belt conveyors 32 and 34, respectively, which positively grip the individual business forms being received from the collator 12. The introductory region of the nip can be adjusted to be divergent in the upstream direction in order to receive different lengths of business forms in a manner well known in the art. Likewise, the rollers at the opposite end of the separator belt conveyors 32 and 34 can be adjusted to open or close the output end for proper delivery to either the creel assemblies 36 or the delivery belt conveyor 38.

Figure 5:
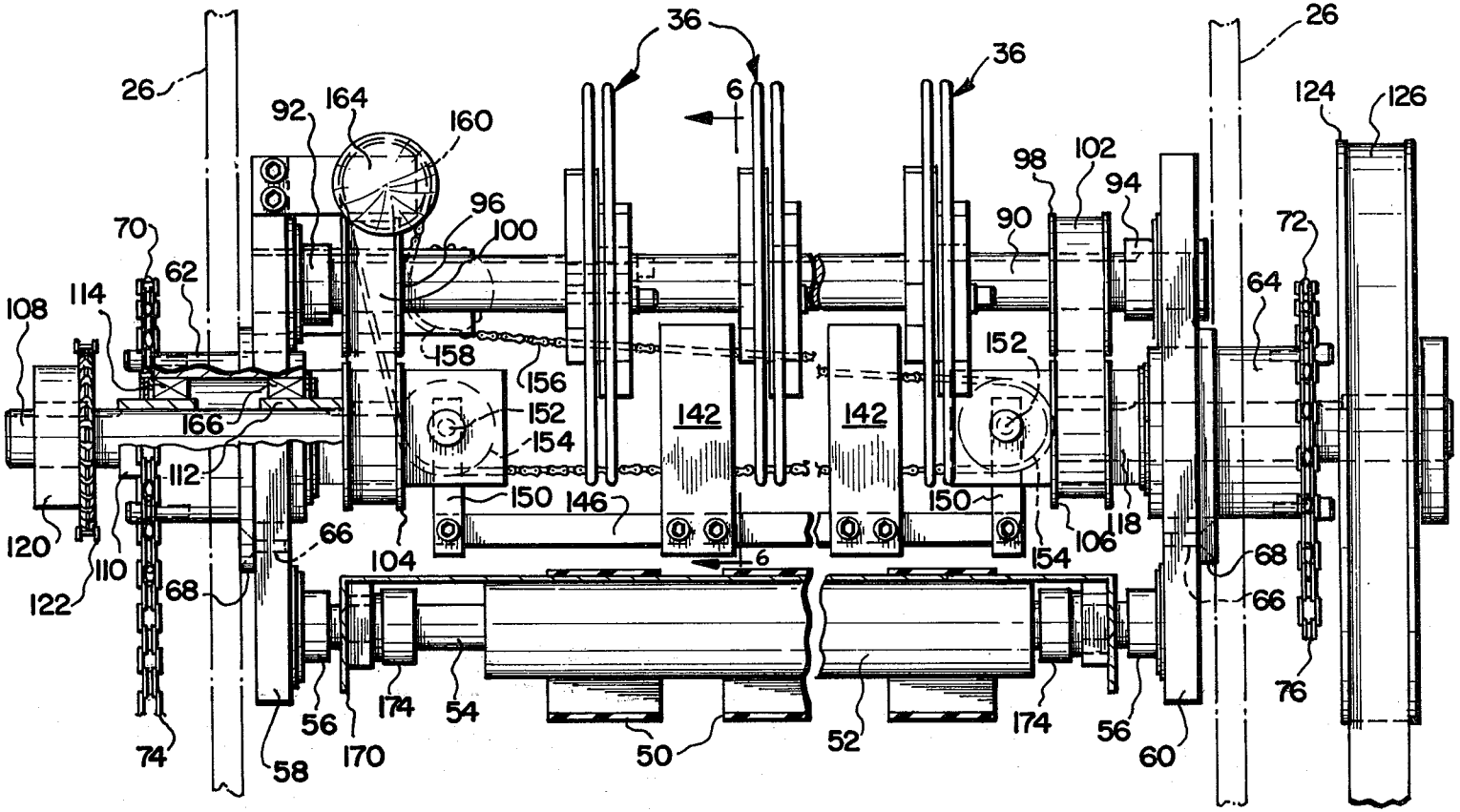
FIG. 5 is a side view, in the direction of line 5—5 of FIG. 4, of a portion of the apparatus, illustrating the positions of the creels and the end of the delivery conveyor as supported by the plates and associated drive mechanisms.

The delivery belt conveyor 38 is similarly constructed of a plurality of endless belts 50 (see FIG. 5) which are mounted in the parallel runs widthwise across the machine and mounted on rollers or rollers so as to produce upper parallel flights to form the conveying surface for a shingled series of business forms. One roller 52, as best seen in FIG. 5, is mounted to a shaft 54 and which is supported in bearings 56 at each end thereof which are, in turn, mounted in support plates 58 and 60. Support plates 58 and 60 are each mounted to a respective short or stub cylindrical hollow housing 62 and 64 extending through a central hole in each of the plates. The plates are secured to the respective housings with a plurality of screws 66 extending through a flange 68 on each so that the plates are fixed to the housings for rotation therewith.

Figure 7:
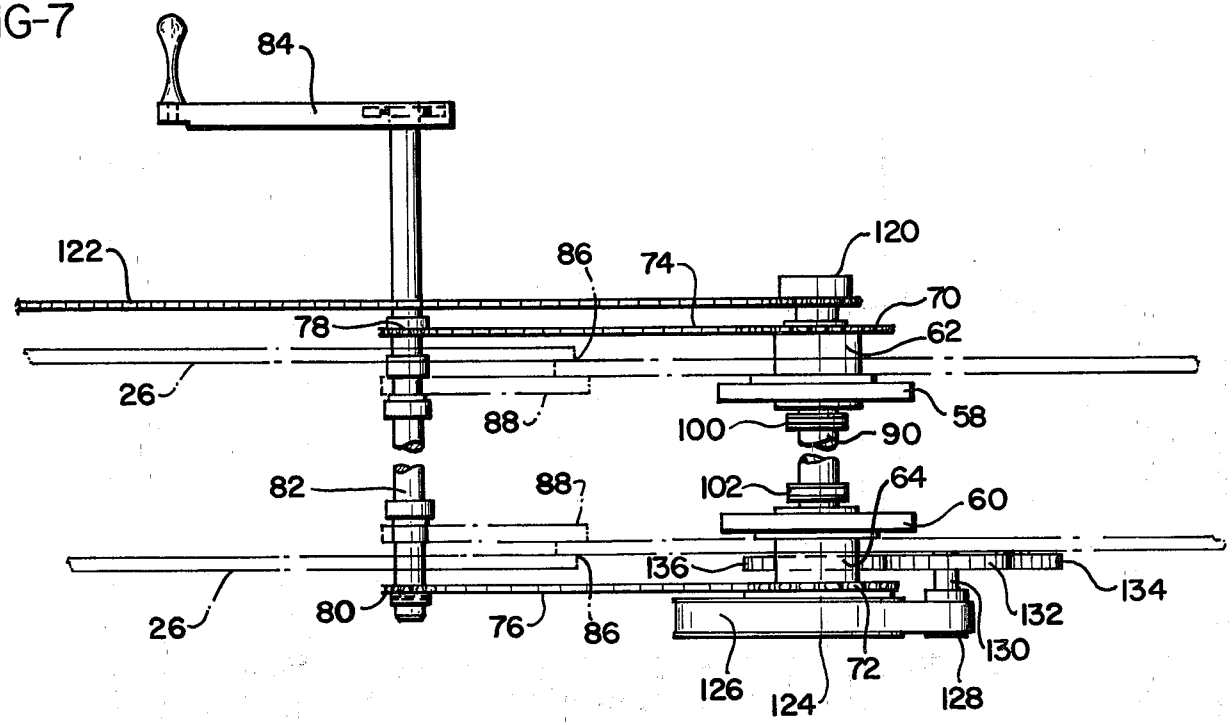
FIG. 7 is a schematic top view of the chain and pulley arrangement for rotating the plates which support the creels and one end of the delivery conveyor.

Each of the housings 62 and 64 are, in turn, mounted in the respective side plates 26 through a bearing or bushing arrangement (not shown) for rotation in these side plates. Sprockets 70 and 72 are respectively bolted to the outer ends of housings 62 and 64 and are engaged by chains 74 and 76, respectively, which, as shown in FIG. 7, extend, respectively, to further sprockets 78 and 80 mounted to shaft 82. Shaft 82 is, in turn, mounted in bearings in side plates 26 and is provided with a handle 84 for rotating the shaft 82.

As seen in FIG. 7, the side plates 26, which are shown in phantom, are somewhat stepped, as at 86, due to being formed of multiple pieces which is of no significance other than to provide a simple means of fabricating these side plates. In any event, a further pair of braces 88 extend from the side plates 26 and lend further support to the shaft 82 which passes through the braces 88 and is provided with a bearing support therein.

Referring again to FIG. 5, also mounted between these support plates 58 and 60 are a plurality of the creel assemblies 36 which are all removably secured to a rotatable shaft 90 mounted at its ends in bearings 92 and 94 which are, in turn, mounted in the support plates 58 and 60, respectively. The number of creel assemblies 36 and their lateral spacing across the width of the machine is dependent upon the width of the business forms being processed and can therefore be adjusted accordingly. In the preferred embodiment, however, there are six creel assemblies 36 evenly spaced across the width of the apparatus. At each end of the shaft 90 adjacent the bearing mounts 92 and 94 are pulleys 96 and 98 which are secured to shaft 90 for rotation therewith and, in turn, support the belts 100 and 102 which extend, respectively, to further pulleys 104 and 106.

Pulley 104 is securely mounted to a shaft 108 for rotation therewith which is, in turn, mounted in sleeves 110 and 112 which are fitted into ball bearings 114 and 116, respectively. Bearings 114 and 116 are fitted within the cylindrical housing 62 in order to permit independent rotation of the shaft 108 and housing 62. Likewise, pulley 106 is securely mounted to a shaft 118 which is mounted in cylindrical housing 64 in the same manner as shaft 108 is mounted in housing 62, in order to permit independent rotation of the shaft 118 and housing 64. Secured to the outer end of shaft 108 for rotation therewith is a sprocket 120 which, in conjunction with the associated chain 122, drives the delivery conveyor 38 as described below.

Secured to the outer end of shaft 118 is a large pulley 124 which is entrained by belt 126. As shown in FIG. 1, belt 126 also entrains a further smaller pulley 128 which is mounted to a common shaft 130 along with an intermediate change gear 132. Shaft 130 is supported for rotation in a bearing mounted within the side plate 26, but extending outwardly therefrom for ease in changing the gear 132. Gear 132 is in intermeshing engagement with idler gear 134 which, in turn, engages drive gear 136. Gears 134 and 136 are likewise mounted on shafts supported in bearings for rotation on side plate 26, as shown in FIG. 1. Mounted on the same shaft with gear 136 is a driven pulley 138 which is entrained by belt 140 that extends to the drive pulley associated with the anvil 16 in the collator 12. Thus, it can be seen that the main drive for the delivery apparatus 10 of the present invention is provided by the drive motor (not shown) in the collator which is associated with the anvil cylinder 16.

Since a belt and pulley arrangement is utilized to provide the drive for rotation of the creel assemblies, i.e. belt 126 and pulleys 124 and 128, the fingers of the creel assemblies may not always be exactly aligned with the output end of the separator conveyors 32 and 34 for receiving business forms. Because of this a tensioning pulley 133 is provided on a plate 135 pivotally mounted to side plate 26 adjacent change gear 132. A threaded rod 137 with a handle 139 is also mounted along the side plate and is received in a threaded pivoting bracket mounted on plate 26 and a further threaded bracket 141 fixed to side plate 26 so that rotation of handle 139 causes tensioning or slackening of belt 126 and, in turn, causes an adjustment of the timing of the position of the fingers of the creel assemblies 36 relative to the output of the separator conveyors.

Figure 6:
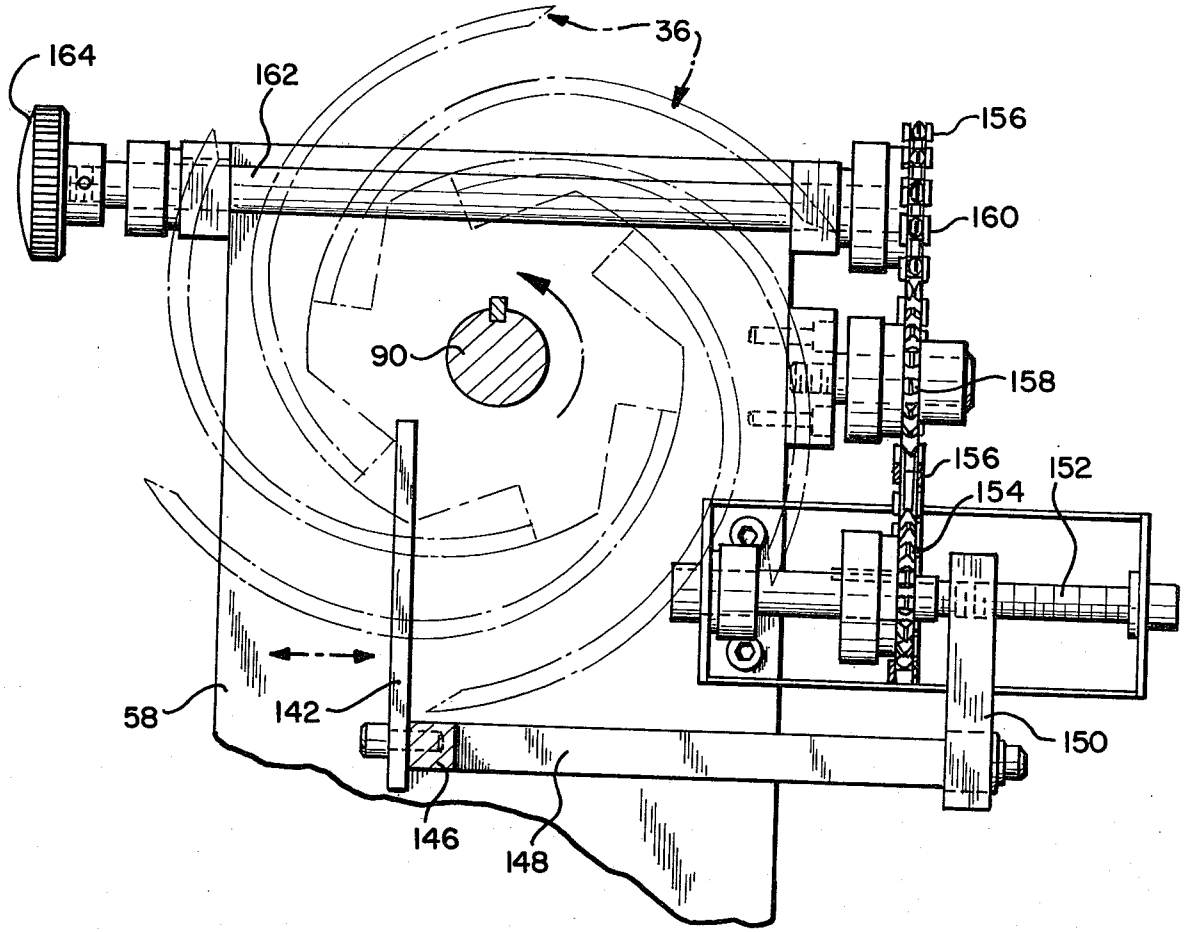
FIG. 6 is a side view of a portion of the apparatus, similar to FIG. 4, with a creel illustrated in phantom to show the relative position of the adjustable stop plate mechanism for removing the business forms from between the fingers of the creels.

Referring again to FIG. 5, it can be seen that a series of stop plates 142 extend upwardly between the creel assemblies 36. The purpose of these stop plates 142 is to establish an exact location at which the business forms are removed from the fingers of the creel assemblies 36 and deposited on the delivery conveyor 38. As seen in FIG. 6, the plates 142 can be adjustably positioned in the path of movement of business forms captive between the adjacent sets of fingers in the creel assemblies 36.

Referring to both FIGS. 5 and 6, the mechanism for adjusting the fore and aft location of the series of stop plates 142 is illustrated. All of the stop plates 142 are mounted to a cross bar 146 which, in turn, is supported in cantilever fashion from a pair of bars 148 which have their opposite ends mounted in respective brackets 150. Brackets 150 have a threaded opening in the upper portion of each and are each mounted on a correspondingly threaded rod 152 which is mounted in bearings at each end and supported in the frame.

Each of the threaded rods 152 has a sprocket 154 which are both entrained by a single chain 156 which extends across the apparatus and upward to an idler sprocket 158 and a drive sprocket 160. Sprocket 160 is mounted on a shaft 162 which is supported in the frame and has a knob 164 on the end thereof opposite sprocket 160 which permits the operator to rotate the shaft 162 in order to rotate the threaded rods 152 through sprockets 156, 158 and 160. This causes the brackets 150 to move forwardly or rearwardly along the threaded rods 152 and thus adjust the position of stop plates 142 in the direction of movement of the business forms.

Referring now to the delivery conveyor 38, as mentioned above, the conveyor consists of a plurality of belts 50 (see FIG. 5) which are evenly spaced across the width of the delivery apparatus and are supported at one end on roller 52. The belts 50 are similarly supported on an opposite end by roller 166 (see FIGS. 2 and 3) mounted to a shaft which has its ends mounted for rotation in the side plates 24. A sprocket (not shown) is mounted on the shaft supporting roller 166, and a chain 122 extends from the sprocket 120 to the sprocket on the shaft supporting roller 166 in order to provide the drive for the delivery conveyor belts 50. An idler sprocket 168 is mounted to the side frame plate 24 to provide intermediate support for the chain 122.

Figure 4:
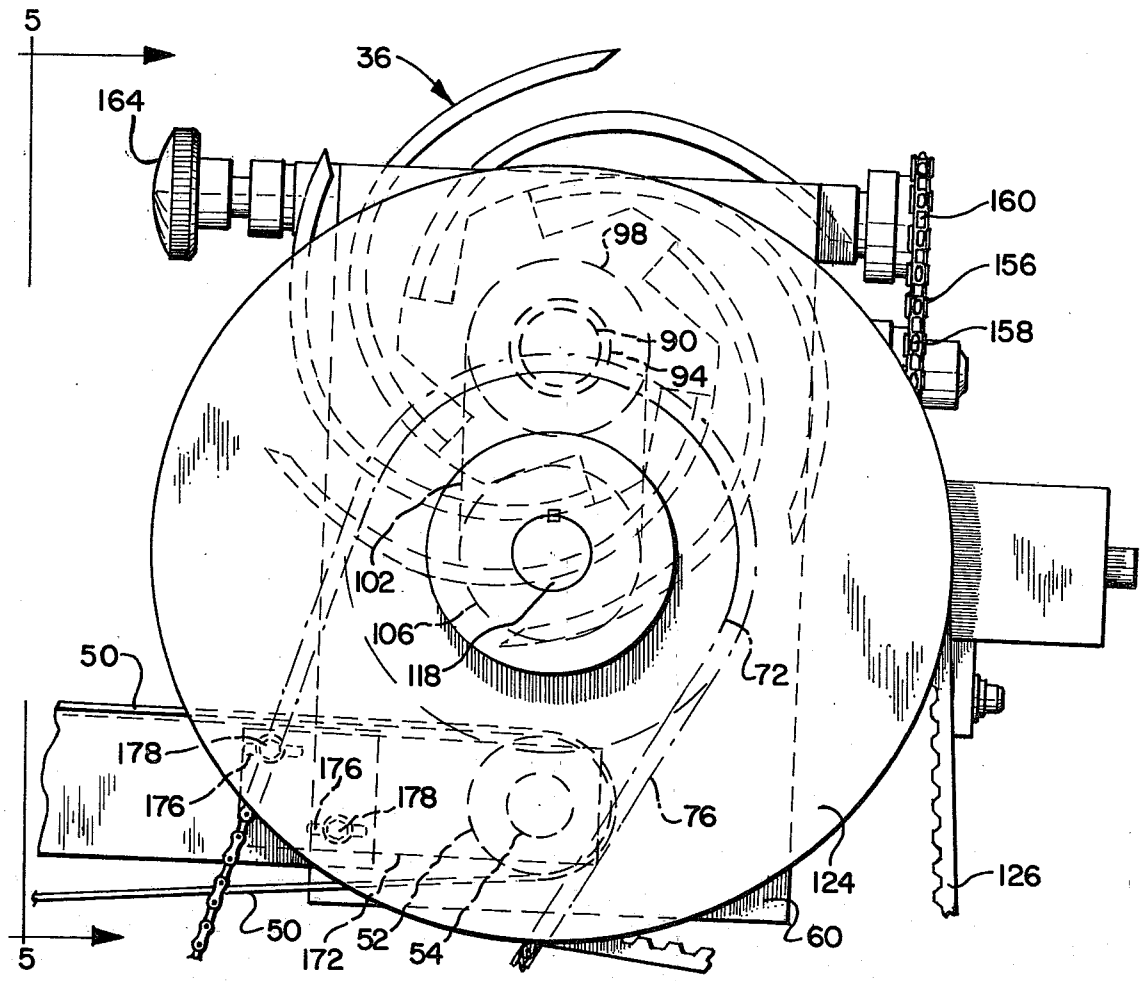
FIG. 4 is a further enlarged detail view of the plates supporting the creels and one end of the delivery conveyor.

The top flights of the belts 50 are all parallel and provide the support surface for the business forms in their shingled position as they are passed to the batching section of the apparatus. Since the expanse of the upper flights of the belts 50 is fairly long, the belts would droop if they were not supported and this could cause distortion and misalignment in the shingled forms as they move along the conveyor. Therefore, a thin sheet metal table 170 is provided which is of channel-shaped configuration as illustrated in FIG. 5. The belts 50 ride on the upper surface of the table 170 and thus provide a flat conveying surface for the shingled line of business forms. The end of the table 170 adjacent the roller 52 is supported on the shaft 54 by means of a pair of brackets 172, one of which is best seen in FIG. 4. Each of the brackets 172 has a hole for receiving the shaft 54 and are each provided with bearing mounts 174 which support the brackets and thus the end of the table 170 on shaft 54 while permitting freedom of rotation of the shaft. An adjustment is provided for proper location of the table by means of slots 176 in the bracket and through which are inserted the bolts 178 which are secured to the table 170.

The opposite end of table 170, as shown in FIG. 2, is supported by a pair of slide members 180 which are positioned near each side plate 24. Each slide member 180 has one end pivotally secured to the end of table 170 and has a slot 182 extending along a substantial portion thereof for receiving a pin 184 which is mounted to the side frame plate 24. A further pin 186 is mounted to each of the side plates 24 and engages the upper surface the respective of slide member 180 to act as a guide in order to properly position the table when the delivery conveyor is disposed in either one of its operative locations as described below.

The reason for the use of the slide member 180 is in order to permit the table to move slightly in a direction parallel to the upper flight of the belts 50 as the support plates 58 and 60 are rotated to move the delivery conveyor 38 between its two operative positions. Since the path of movement of roller 52 is such that a contraction of the distance between the rollers 52 and 166 occurs, some means must be provided for preventing interference between the table and the rollers as the movement is taking place. A tensioning roller 188 is also provided in order to take up the slack in the belts 50 when the delivery conveyor 38 is moved between its two operative positions. Roller 188 is mounted on a pivoting arm 190 which is biased against the belts 50 by spring 192 which has its opposite end connected to a stationary brace 194 mounted to side frame plate 24.

Positioned above the delivery conveyor 38 are a pair of conventional stop wheels 196 which are utilized in a well known manner in order to establish proper alignment in the shingled business forms on the delivery conveyor. The stop wheels 196 are supported on wire form brackets 198 disposed on each side of the apparatus and have one end pivotally mounted to a shoulder screws 200 supported by brackets 202 which are mounted to the outer edges of table 170. The wire forms are provided with long loops which define slots through which bolts in the support members for the stop wheels extend in order to permit the stop wheels to be positioned along the upper surface of the delivery conveyor at a desired location.

Downstream of the delivery conveyor 38 is the sweep belt conveyor 40 and a stop gate 212. Devices of these type are generally known for the purpose of temporarily interruping the flow of business forms at a predetermined number having passed through the gate 212, and for rapidly passing the remaining forms of the batch along the sweep conveyor 40 to the batching tray 42 for accumulation prior to beginning the next batch.

The gate 212 illustrated has a resilient bar 214 extending laterally across the flow path of the business forms as they proceed from the delivery conveyor 38 to the sweep conveyor 40, and is positioned between the two conveyors. The bar 214 is mounted to a rigid rectangular bar 216 which, in turn, is supported on a pair of movable rods 218 on each side of the apparatus and biased downwardly towards the conveyors by springs 220. A corresponding resilient bar 222 is positioned beneath the flow path of the business forms and is supported on a rigid bar 224 mounted to the top of a pair of laterally spaced pneumatic cylinders 226 mounted to the respective side frames 24.

As shown in FIG. 1, the sweep belt conveyor 40 is normally driven by a pair of sprockets 228 and 230 which are interconnected by chain 232. Sprocket 230 is on a common shaft with the drive for the delivery belt conveyor 38 and thereby provides the drive for sprocket 228 which is on a common shaft with a roller 234 supporting a plurality of belts 235 forming the sweep belt conveyor 40. A further roller 236 provides support for the opposite end of the sweep belt conveyor adjacent the batching tray 42.

When the gate is activated to interrupt the flow of business forms from the delivery conveyor 38 to the sweep belt conveyor 40, a motor 238 is simultaneously activated which, through the belt 240 and pulley 242, speeds up the sweep belt conveyor 40 through an overriding clutch connection between the pulley 242 and shaft supporting the roller 234. This speeds up the final batching of the predetermined number of business forms and reduces the time of delaying the continuous movement of forms from the delivery belt conveyor. The use of such a gate and sweep belt conveyor is well known in the art and therefore forms no part of the present invention. Likewise, the batching tray 42 is of conventional construction and can actually be formed of any of a variety of batching mechanisms including joggers or packing equipment, etc.

Figure 11:
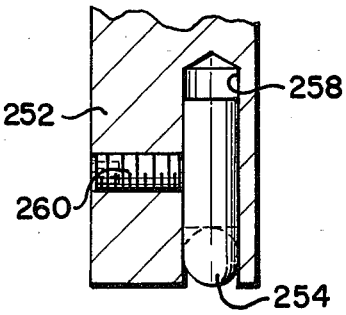
FIG. 11 is an enlarged partial cross sectional view in the direction of line 11—11 of FIG. 8, which illustrates the connection of the creel fingers to the creel finger support plates.

Referring now to the individual construction of each of the creel assemblies 36 as illustrated in FIGS. 8 through 12, a pair of formed plates 250 and 252 each support a plurality of spirally formed members or fingers 254, with the preferred embodiment utilizing three fingers on each of the formed plates 250 and 252. In the preferred form, each of the fingers 254 is formed of rigid wire with the outer end portions 256 cut in an angle to assist in directing an individual business form between adjacent pairs of fingers 254. The innermost end of each of the fingers 254 is bent at a 90° angle and inserted in a corresponding hole 258, as shown in FIG. 11, and each is held in position by a retaining screw 260 threaded into the side of the plates 250 and 252 at the location of each of the holes 258. This construction permits ease of removal and replacement of damaged or bent fingers 254, if this becomes necessary.

Figure 8:
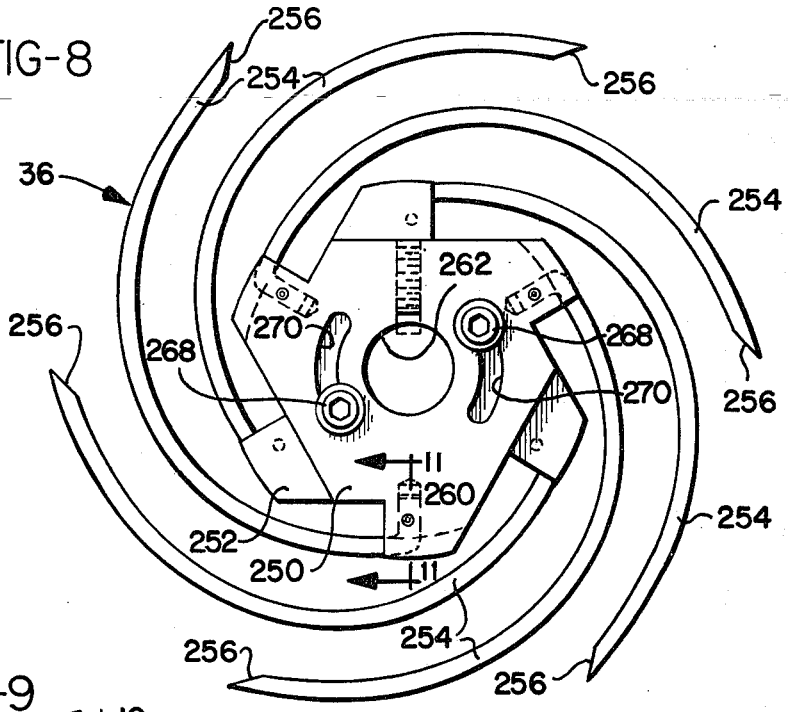
FIG. 8 is a detailed side view of a creel assembly positioned to have the maximum number of fingers for receiving business forms.
Figure 9:
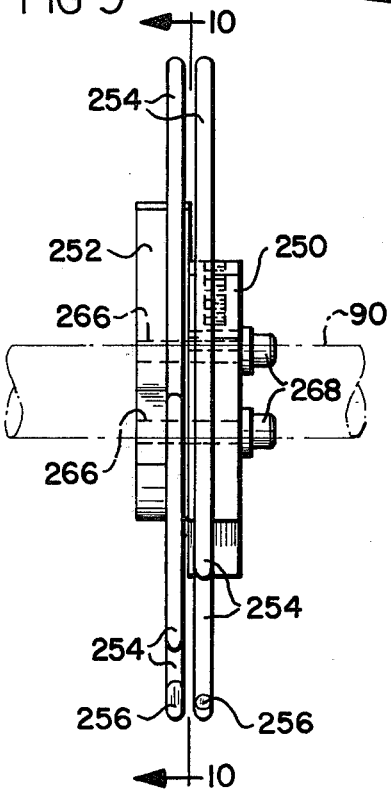
FIG. 9 is an end view of the assembly of FIG. 8 with the main support shaft for the creels being shown in phantom.
Figure 10:
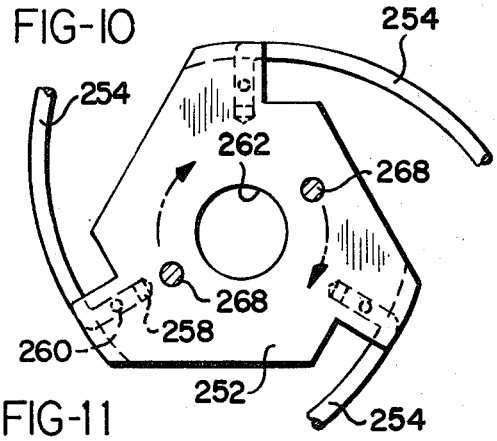
FIG. 10 is a partial sectional view along the line 10—10 of FIG. 9.
Figure 12:
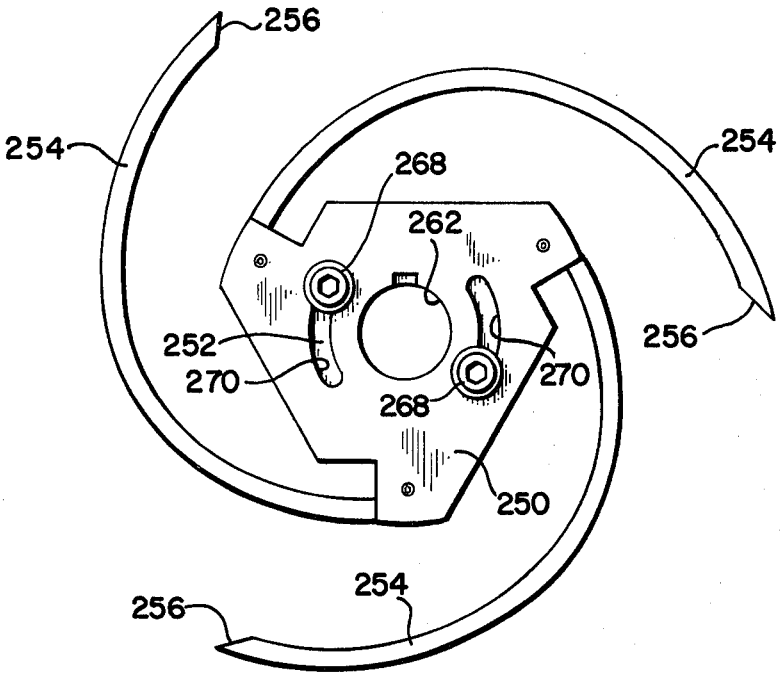
FIG. 12 is a side view of a creel assembly with the creel fingers phased to have the minimum number of fingers available for receiving business forms.

Each of the plates 250 and 252 are provided with central openings 262 which can be aligned and mounted on a common support shaft 90 which, in turn, is mounted in the support plates 58 and 60, as mentioned above. Plate 252 is provided with a pair of diametrally opposed threaded openings 266 which receive bolts 268. Bolts 268 extend through slots 270 defined in plate 250 which permit approximately 90° of relative movement between plates 250 and 252 in order to position the fingers as shown in either FIG. 8 or FIG. 12. As shown in FIG. 8, the fingers of plate 252 are positioned intermediate the fingers of plate 250, or as shown in FIG. 12, the fingers of both plates are in aligned or phased relationship so that only three fingers define slots for receiving business forms. Once the fingers are positioned in either of the positions of FIG. 8 or 12 the bolts 268 are tightened to hold the fingers in these relative positions.

The reason for this construction of the creel assemblies 36 is that it has been discovered that a single creel construction having a predetermined number of fingers does not provide the optimum receiving capability for the wide range of business forms that are generally sorted by the industry. For example, business forms in the range of 2 3/5 inches to as high as 17 inches in length in the direction of travel of the business forms, are often sorted and a single form of creel with a fixed number of fingers is generally not capable of efficiently receiving this diversity in length of business forms and processing them at the desired operating speeds of the equipment.

Referring now to the method of operation of the delivery apparatus 10 of the present invention, as shown in FIG. 1, business forms are received from the collator 12 as the forms are cut into discrete lengths by the cutter cylinder 14 in conjunction with the anvil cylinder 16. The infeed or separator conveyors 32 and 34 grip each of the forms and convey them into the delivery apparatus, preferably at a speed higher than the speed of movement of the business forms as they come from the collator 12, in order to produce a separation in the direction of movement of the forms, although depending upon the sorting and batching techniques being utilized, this may or may not be necessary.

Assuming that it is desirable in a particular run of business forms to invert the forms for batching in a "face down" position, the creel assemblies and delivery belt conveyors will be positioned as illustrated in FIG. 1. In this position the creel assemblies 36 are disposed adjacent the output end of the separator conveyors for receiving the individual business forms between adjacent pairs of fingers. The creels rotate in a counterclockwise direction, as illustrated in FIG. 1, and deposit the individual business forms on the upper surface of the delivery conveyor 38 at an exact location established by the plates 142.

The delivery conveyor moves at a slower speed than the separator conveyors and the creel assemblies and thus a shingling of the business forms occurs on the delivery conveyor. The business forms are then conveyed along the delivery conveyor to the sweep belt conveyor which is normally running at the same linear speed as the delivery conveyor and which, in turn, deposits the forms in the batching tray 42.

As mentioned above, when the counting mechanism has determined that the requisite number of business forms has passed the counting point and a sufficient time occurs for the forms to pass by the gate, the gate will be activated and the sweep belt will simultaneously increase its speed in order to deposit the remaining business forms in a given batch in the batching tray 42, as fast as possible. The gate is then lifted, the sweep belt returned to its normal operating speed and the business forms will then move from the delivery conveyor to the sweep belt conveyor to continue the next collection of a batch in the tray 42.

When it is desired to collect the batches in "face up" condition, before beginning the run, the operator rotates the handle 84 in the clockwise direction as illustrated in FIG. 1, which, in turn, causes rotation of the support plates 58 and 60 causing the creel assemblies 36 to be rotated in a clockwise direction down out of the way, and simultaneously causes the roller 52 supporting one end of the belts of the delivery conveyor 38 to be rotated up into position adjacent the separator belt assemblies as is illustrated in FIG. 3. With the delivery conveyor 38 in this position the forms from the separator conveyors are received and conveyed in the same "face up" condition in which they pass from the collator 12 into the separator conveyors. The only difference is that the delivery conveyor is run at a lesser speed than the separator conveyors so that the business forms are shingled in their "face up" condition and then passed along the delivery conveyor and sweep belt conveyor to the batching tray 42. Individual batches are then accumulated in the same manner, as described above, through operation of the gate and sweep belt assemblies.

Thus, it can be seen, that the present invention provides a quick and easy means of providing either "face up" or "face down" batching of business forms in a manner which has heretofore been unavailable in prior art equipment.

While the form of apparatus herein described constitutes a preferred embodiment of this invention, it is to be understood that the invention is not limited thereto, and that changes may be made therein without departing from the scope of the invention.

What is claimed is:

1. Apparatus for delivering business forms selectably in a face up or face down position, comprising:

a stationary frame;

a pair of horizontally spaced vertically extending parallel plates mounted to said frame for rotation about a fixed horizontal axis;

a shaft mounted at its ends to said plates for independent rotation in spaced parallel relation to said axis of said plates;

a plurality of creels secured at spaced intervals along said shaft for rotation therewith;

a plurality of endless delivery belts having adjacent flights in a common plane for receiving and transporting said forms;

a plurality of pulleys supporting said belts for rotation;

a first set of said pulleys being mounted to said plates for rotation along a common axis in spaced parallel relation to said fixed horizontal axis of said plates and remote from said shaft;

a second set of said pulleys being mounted for rotation to said frame; and means for rotating said plates about said fixed horizontal axis of said plates between a position in which said creels are disposed for receiving forms, inverting them and depositing them on said delivery belts, and a position in which said creels are in an inoperative position and said delivery belts are disposed for receiving and transporting forms in their original face up or face down position.

2. Apparatus as defined in claim 1 wherein said means for rotating said plates includes:

a pair of hollow shafts mounted for rotation in said frame concentric with said fixed horizontal axis of said plates and one each supporting a respective one of said plates for rotation;

a first sprocket mounted to said hollow shaft for rotation therewith;

a second sprocket mounted for rotation to said frame;

an endless chain mounted to said sprockets; and means for rotating said sprocket mounted to said frame.

3. Apparatus as defined in claim 2 including:

a pair of stub shafts extending concentrically through respective said hollow shafts and supported thereby for independent rotation;

belt and pulley means interconnecting one of said stub shafts with a respective end of said shaft carrying said creels for causing rotation thereof;

further belt and pulley means interconnecting the other of said stub shafts with said second set of pulleys mounted to said frame for rotating said endless delivery belts upon rotation of said stub shafts.

4. Apparatus as defined in claim 3 including:

stop means disposed between adjacent pairs of said creels and mounted to said plates for rotation therewith for engaging said forms in said creels after they have been inverted and dislodging said forms in said creels so that they are deposited on said delivery belts.

5. Apparatus as defined in claim 4 wherein said stop means includes:

a plurality of plates intermeshingly disposed between said creels for dislodging said forms; and means supporting said plates for adjustably positioning them for engaging said forms at a desired location in the rotational path of said creels.

6. Apparatus for delivering business forms selectably in a face up or face down position, comprising:

a frame;

first means mounted in said frame for receiving a single line of forms all face up or face down in a continuous stream with a predetermined separation between adjacent forms and for continuously transporting the forms in their separated position to a forms position selection station;

second means mounted in said frame and positionable at said forms position selection station for receiving and delivering said forms from said first mentioned receiving means in the same face up or face down position said second mentioned receiving means including a plurality of endless belts rotatably supported on a plurality of pulleys and having flights in a common plane for receiving said forms from said first mentioned receiving means and transferring them along said plane to a remote location;

drive means for rotating said belts and pulleys;

further means mounted in said frame and positionable at said forms position selection station for receiving said forms from said first mentioned receiving means, inverting said forms from a face up and face down position or vise versa and delivering the inverted forms to said second mentioned receiving means said further receiving means including a plurality of creels mounted to a shaft for rotation therewith and each having a plurality of members extending spirally outward from said shaft for receiving individual forms therebetween from said first mentioned receiving means and for depositing said forms in an inverted position on said second mentioned receiving means for movement to said remote location; and means mounted in said frame for selectably positioning said second mentioned receiving means or said further receiving means in position for receiving forms from said first mentioned receiving means, said positioning means including a pair of spaced support plates mounted to said frame for rotation about an axis and supporting said shaft eccentric to said axis for rotation of said shaft about said axis and supporting some of said pulleys eccentric to said axis and remote from said shaft so that rotation of said plates about said axis selectably moves said creels or said belt flight into said forms position selection station to receive said forms from said first mentioned receiving means.

7. Apparatus as defined in claim 6 wherein said second mentioned receiving means includes two sets of pulleys disposed in parallel spaced relation and supporting said belts to define said flight with a first set of said pulleys being mounted to a shaft mounted to said frame for rotation in a fixed location and a second set of said pulleys being mounted to a further shaft mounted to said parallel plates so that rotation of said plates can be effected in a direction which reduces the distance between said sets of pulleys to slacken said belts as said second mentioned receiving means is moved into and out of said forms position selection station.

* * * * *